US011498755B2

(12) United States Patent
Young et al.

(10) Patent No.: US 11,498,755 B2
(45) Date of Patent: Nov. 15, 2022

(54) CONTROLLED NITROGEN BLANKETING SYSTEMS

(71) Applicants: Gregory E. Young, Prescott Valley, AZ (US); Zane A. Miller, Loganville, GA (US)

(72) Inventors: Gregory E. Young, Prescott Valley, AZ (US); Zane A. Miller, Loganville, GA (US)

( * ) Notice: Subject to any disclaimer, the term of this patent is extended or adjusted under 35 U.S.C. 154(b) by 389 days.

(21) Appl. No.: 16/563,513

(22) Filed: Sep. 6, 2019

(65) Prior Publication Data

US 2019/0389654 A1 Dec. 26, 2019

Related U.S. Application Data

(63) Continuation-in-part of application No. 15/825,038, filed on Nov. 28, 2017, now Pat. No. 10,829,298, and (Continued)

(51) Int. Cl.
*B65D 90/503* (2019.01)
*B65D 90/44* (2006.01)
(Continued)

(52) U.S. Cl.
CPC ..... *B65D 90/44* (2013.01); *B67D 7/3227* (2013.01); *F17C 13/025* (2013.01); *F17C 2205/0332* (2013.01)

(58) Field of Classification Search
CPC ..... B65D 90/44; B65D 90/503; F17C 13/025; F17C 2205/0332; F17C 2250/0626; F17C 2250/043; F17C 2221/032; F17C 2201/0104; F17C 2260/038; F17C 2203/0629; F17C 2250/036; F17C 2250/032; F17C 2250/0443; F17C 2201/054; F17C 2270/0147; F17C 2203/0682; B67D 7/32; B67D 7/04; B67D 7/3227
See application file for complete search history.

(56) References Cited

U.S. PATENT DOCUMENTS 1,858,610 A 5/1932 Banning, Jr.
2,732,095 A 1/1956 Fashay
(Continued)

FOREIGN PATENT DOCUMENTS

AU 2011213708 9/2011
CN 203408423 U 1/2014
(Continued)

*Primary Examiner* — Marina A Tietjen
(74) *Attorney, Agent, or Firm* — Bycer & Marion, PLC; Matthew L. Bycer; Michael B. Marion

(57) ABSTRACT

An underground storage tank maintenance system includes a system of monitors to determine pressure and humidity in the system. Inert gas may be supplied into the ullage of the tank. The inert gas may first pass through an interstitial space as between the primary storage and secondary containment, and then passed into ullage to capture contaminants on the way out of the vent to atmosphere. The system and method prevent hydrocarbons exiting to atmosphere. Humidity sensors may be set along vent to determine water contamination and trigger drying cycles. Pressure readings help identify system leaks.

24 Claims, 2 Drawing Sheets

Related U.S. Application Data a continuation-in-part of application No. 15/782,472, filed on Oct. 12, 2017, now abandoned.

(60) Provisional application No. 62/727,981, filed on Sep. 6, 2018, provisional application No. 62/727,964, filed on Sep. 6, 2018.

(51) Int. Cl.
*F17C 13/02* (2006.01)
*B67D 7/32* (2010.01)

(56) References Cited

U.S. PATENT DOCUMENTS

| | | | |
|---|---|---|---|
| 2,860,815 | A | 11/1958 | Finn |
| 2,870,936 | A | 1/1959 | Clayton |
| 2,889,955 | A | 6/1959 | Naulty et al. |
| 2,918,928 | A | 12/1959 | Rednour |
| 2,964,916 | A | 12/1960 | Keeping |
| 3,467,349 | A | 9/1969 | Gautier |
| 3,693,915 | A | 9/1972 | Ulanovsky |
| 3,732,668 | A | 5/1973 | Nichols |
| 3,788,039 | A | 1/1974 | Bragg |
| 3,830,307 | A | 8/1974 | Bragg |
| 3,935,957 | A | 2/1976 | Hasegawa |
| 4,378,920 | A | 4/1983 | Runnels |
| 5,094,267 | A | 3/1992 | Ligh |
| 5,423,344 | A | 6/1995 | Miller |
| 5,660,204 | A | 8/1997 | Piotrowski |
| 5,764,716 | A | 6/1998 | Eckardt |
| 5,816,283 | A | 10/1998 | Ostand |
| 5,836,348 | A | 11/1998 | Ostand |
| 5,904,190 | A | 5/1999 | Patel |
| 5,979,481 | A | 11/1999 | Ayresman |
| 6,152,192 | A | 11/2000 | Klotz et al. |
| 6,326,896 | B1 | 12/2001 | McDermott |
| 6,581,694 | B2 | 6/2003 | Golner et al. |
| 6,634,598 | B2 | 10/2003 | Susko |
| 6,843,269 | B2 | 1/2005 | Verma |
| 7,296,586 | B2 | 11/2007 | Hosoda |
| 9,511,874 | B2 | 12/2016 | Tiger |
| 10,036,509 | B2 | 7/2018 | Markham |
| 2002/0084080 | A1 | 7/2002 | Golner et al. |
| 2004/0046670 | A1 | 3/2004 | Adams |
| 2004/0234338 | A1 | 11/2004 | Monroe |
| 2007/0138031 | A1 | 6/2007 | Miksic et al. |
| 2007/0157803 | A1 | 7/2007 | McNeil |
| 2010/0097232 | A1 | 4/2010 | Lee |
| 2012/0037243 | A1 | 2/2012 | Taylor |
| 2015/0041011 | A1 | 2/2015 | Tiger |
| 2017/0030521 | A1* | 2/2017 | Markham ..... B65D 90/00 |
| 2018/0093825 | A1 | 4/2018 | Young |

FOREIGN PATENT DOCUMENTS

| | | |
|---|---|---|
| GB | 826965 | 1/1960 |
| WO | WO 03/046422 A1 | 6/2003 |

* cited by examiner

CONTROLLED NITROGEN BLANKETING SYSTEMS

CLAIM OF PRIORITY

The present application includes subject matter disclosed in and claims priority to U.S. Patent Application Publication No. 2018/0093825 entitled "Gas Blanketing System For Low-Pressure Hydrocarbon Tanks" filed Nov. 28, 2017; U.S. Patent Application Publication No. 2018/0106430 entitled "Low Volume Nitrogen Systems" filed Oct. 12, 2017; U.S. Provisional Patent Application No. 62/727,981 entitled "Improved Nitrogen Blanketing Systems" filed Sep. 6, 2018; and U.S. Provisional Patent Application No. 62/727,964 entitled "Tank Over Pressurization Alarm" filed Sep. 6, 2018, applications hereby incorporated by reference.

BACKGROUND OF THE INVENTION

Field of Invention

The present invention is related to inert gas blanketing systems for underground storage tanks, and more particularly directed towards an improvement in nitrogen gas blanketing of ullages in underground storage tanks to protect various interior tank surfaces.

The present invention is useful in underground hydrocarbon fuel tanks used at retail or commercial fuel pumping and dispensation sites, including gas stations.

SUMMARY OF THE INVENTION

The present invention is directed towards an improvement in nitrogen gas blanketing (or other inert gases) in the ullage of an underground storage tank. The use of a flow of inert gas through the ullage, or across the ullage, may be useful to ensure that surfaces of the tank, and relative components, couplers, tubing, etc. are continually relieved of excess water and other unwanted chemicals and/or pathogens. It is preferable that a continuous flow of nitrogen may pass across either the ullage, and/or the interstitial space between the primary and secondary containment tanks. In one embodiment of the present invention, gas will flow into the interstitial space out of the interstitial space into an ullage, and then out of a vent to atmosphere. In an alternative embodiment of the current invention, inert gas will flow into the ullage, and thereby enter the interstitial space prior to exiling interstitial space. An orifice, preferably variable, and a gauge to measure or determine flow volume such as a flow gauge, may be used to provide for such entry. A flow gauge may be used to provide for continuous flow at a low rate into the interstitial space, and/or the ullage, while a differential switch, and/or various low volume/high volume booster regulators, may be used to trigger high volume inert gas provisions during such times as it may be needed. High volume needs may occur when a portion or volume of the tank contents (hydrocarbon fuels) are replaced and/or removed. During high volume needs, inert gas may flow more quickly to replace volume loss from activities with contents of the tank.

Additionally, more sophisticated systems may include one or more timers that can release a controlled flow of dry inert gas into the tank system for designated periods of time to provide for drying atmosphere. Further, systems may include timers and sensors to build pressure to force exhausting by flowing ullage vapor out through a vent past a refined hydrocarbon (RH) sensor, the RH sensor determining if RH content of exiling fluids is above a desired level. Undesired levels of RH may trigger the system to continue the drying process of the ullage vapor until RH levels falls below the predetermined, desired level. Alarms may notify when moisture content of ullage vapor or exhaust fluids is above a certain level. The system may also monitor pressure, flow, and system failures including lack of source of dry inert gas or of an open tank scenario (reduced or atmospheric pressure).

BRIEF DESCRIPTION Of THE DRAWINGS

The present invention will be described with greater specificity and clarity with reference to the following drawings, in which.

DETAILED DESCRIPTION OF THE PREFERRED EMBODIMENTS

Figure 1:
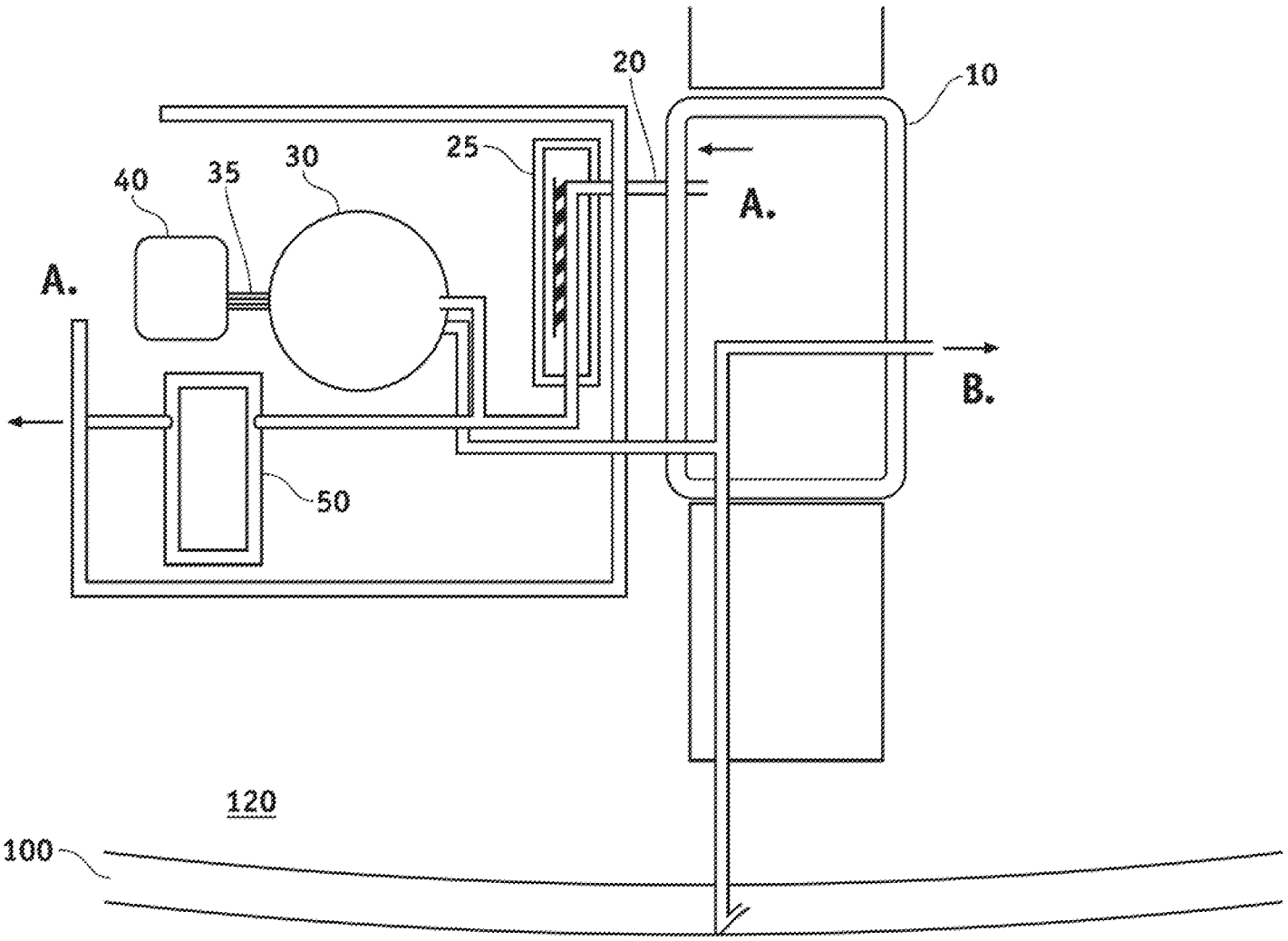
FIG. 1 demonstrates a schematic of the flow gauge coupler and a cross-section of the tank utilizing the gas supply and gas flow of the present invention.

An underground storage tank as is known in the art typically includes primary and secondary containment. The primary containment, or otherwise known as the interior tank, interacts with the content storage (typically hydrocarbon fuels). A secondary containment may be provided around the primary containment, and provide for additional security should the primary tank fail. The space between the primary and secondary tank is typically referred to as an interstitial space. Interstitial spaces often run along the complete exterior surface area of the primary tank, but may include sections where dual containment is not provided, and/or where interstitial space is minimized to zero as primary and secondary tank meet (such as a coupler, etc.). In underground storage tanks, there is typically access to the interstitial space. This access to the interstitial space is often provided to allow determination whether or not there is a leak in the secondary containment. Leaks in the secondary containment are often indicated via the presence of water and/or fuel, etc. in the interstitial space.

It is contemplated that a riser may provide access from atop the tank system to the atmosphere (at ground level) and sink to the bottom of the tank interstitial space. The riser may include a coupling and vent to atmosphere to allow for the interstitial space to equalize pressure with the atmosphere. Furthermore, a single drop line can be lowered into the riser tubing to allow access the bottom of the interstitial space, which can be used, inter alia, to check for pooled liquids in the interstitial space local low(s). In prior embodiments, the interstitial space had been sealed to atmosphere. The purpose of allowing access to atmospheric pressure in the interstitial space is to prevent high pressure, and/or vacuum, on the exterior of the primary tank due to various events that may cause pressure rise or drop in the interstitial space.

The present system may provide a supply of nitrogen gas into and through the interstitial space into the ullage. As used herein, the dry inert gas is preferably nitrogen, but may include any inert gases known in the art for ullage maintenance. References to nitrogen gas may be understood to include any single or combination of such inert gases as are known in the art. A continual pressure is provided by the supply of nitrogen gas into the interstitial space. The nitrogen gas flows and exits the interstitial space into a portion of the underground storage tank ullage. The constant supply of nitrogen may raise the pressure in the ullage. Rising pressures in ullage may cause the ullage vapors to vent through a pressure vacuum valve when a threshold pressure is met. In this fashion, nitrogen gas may constantly, or at times, enter the system through the ullage, and exit through the pressure vacuum valve for a flow of nitrogen gas through the tank system and out into atmosphere. The supply of inert gas into the ullage (often from the interstitial space) causes higher pressures to prevent the inflow of gas from outside the system (atmosphere/environment), for instance when pressures in the ullage may drop below a certain threshold (e.g. on dispensation of fuel) and otherwise cause the pressure vacuum valve to suck in, or intake, gas to stabilize the pressure system in the tank and eliminate vacuum within the ullage.

One may monitor the flow of nitrogen gas into the tank via a differential switch. Differential switches may provide for notification when pressures are high or low within the interstitial space for the ullage. When supplying nitrogen gas into/through the lowest part of the interstitial space, one may detect the presence of liquid by the pressure required to provide nitrogen gas into the interstitial space. For instance, if the interstitial space is filled with liquid, the provision of nitrogen gas may require additional force in order to pass through a partially occluded passageway, or even lift/displace at least a portion of liquid in the interstitial space to provide nitrogen gas flow therethrough. In this manner, by monitoring pressures and/or flow rates, one may detect liquids in the interstitial space. In one embodiment, one may provide five inches of water column pressure to nitrogen gas provisions into the interstitial space. One may monitor pressure into the interstitial space, and detect liquids or obstructions in the interstitial space should there be any.

Referring to FIG. 1, flow in and out of the tank system is demonstrated at right. "A" demonstrates an inert gas flow, from nitrogen source 10 providing, working fluid gas passes source tubing 20 into the interstitial space. Incoming flow in tubing 20 passes flow gauge 25 and further by differential pressure switch 30 allowing detection of pressures, preferably against predetermined levels/thresholds. If the pressure meets or exceeds a threshold, a signal is sent in wiring 35 to trigger an alarm 40 to activate and communicate an issue with the interstitial space (or elsewhere in the system). A low pressure regulator 50 is provided along tubing. "B" demonstrates outflow of nitrogen gas (potentially mixed with contaminants such as water vapor) out of the interstitial space 100 into the atmosphere or ullage 125 (see FIG. 2) of primary tank 120.

Figure 2:
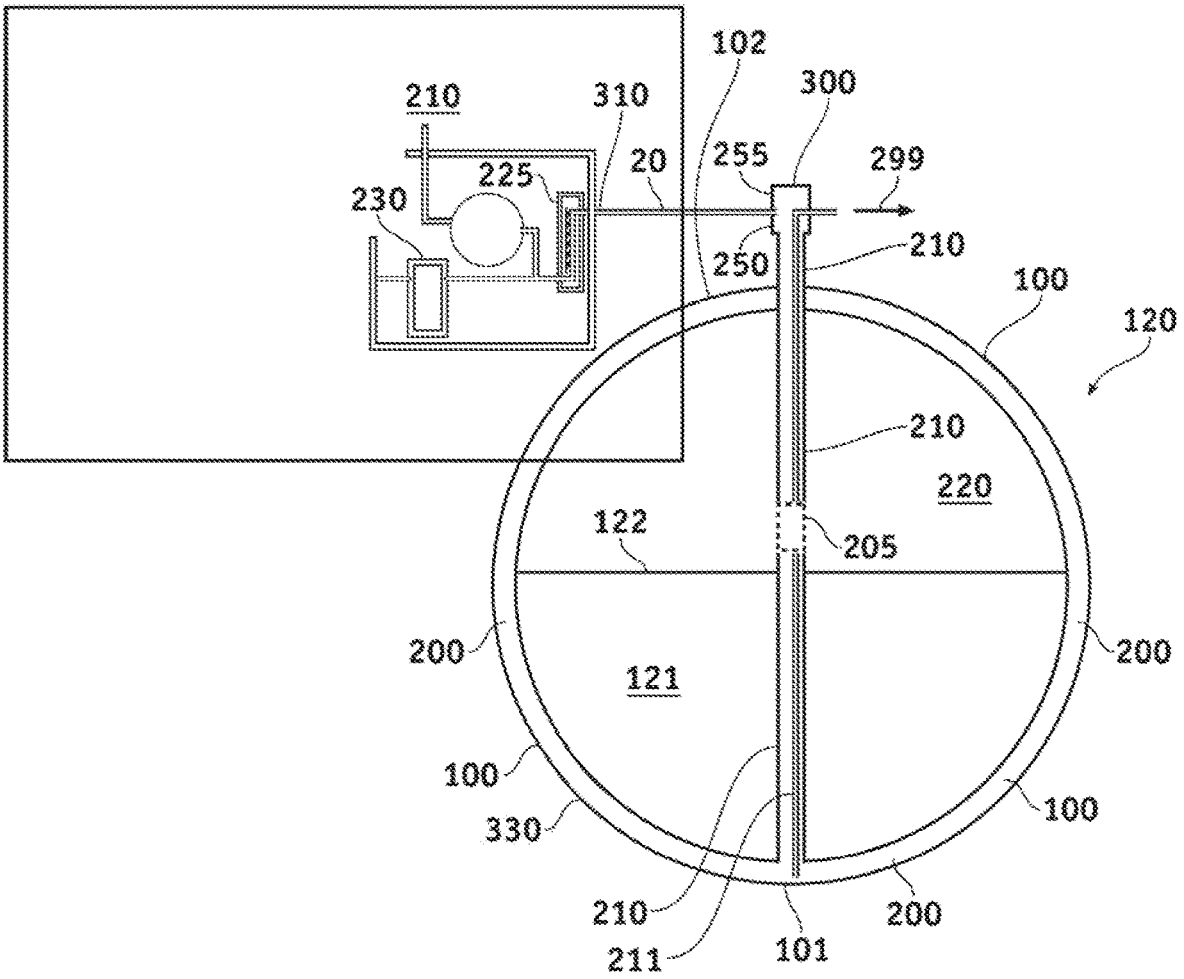
FIG. 2 demonstrates a cross-sectional side view of a tank system with attached inert gas supply, interstitial space and riser.

Referring now to FIG. 2, flow may be provided from dry gas source 210 through flow gauge 225 and past differential switch 230 (connected to alarm 240 wired or wireless) via tubing 20 and through the riser coupling 110 into the interstitial riser 210 and then onto the annular space 200 of the interstitial 100. Gas may be provided at a high point 290 and pass down through interstitial space 100 down to bottom 101 to be picked up through riser 210 and out vent 250 (preferably pressure vacuum valve 255) to atmosphere 299, possibly through pressure vacuum valve (not shown). Alternatively, gas may flow out of the interstitial space into the ullage 220 of tank 120 above fuel 121 and fuel line 122. In such alternative, gas will pass through a portion of ullage and out standard venting, e.g. pressure vacuum valve.

Inert gas may flow from tubing 20 and source 210 into vent 250 or interstitial riser 210, or otherwise be directed to a high point 102 of interstitial space 100. Gas may flow through annular space 200 to reach bottom 101 where it may be picked up by riser tube 211 to pass through riser 210 and out vent 250 to atmosphere. Alternatively, inert gas may pass out of riser 210 at riser opening 205 at or near top of tank to gas out into ullage 220. A separate vent (or vent opening) may be coupled to tank to provide for outgassing through a pressure vacuum valve. It is contemplated, that in such flow where gas enters ullage, the point at which riser outgasses inert gas into ullage is far removed (possibly at opposite ends of tank) from opening to vent, thus causing the inert gas to pass through a long distance, perhaps up to half or all of ullage length, prior to exit through vent.

A constant pressure is provided as nitrogen gas (lows into the interstitial space, and continues to (low through system. It is preferred that the continual flow of nitrogen meets, or is less than, the amount of nitrogen that is able to lie produced on-site, or can be provided in large tanks for a set number of days, weeks, or months.

The present invention may allow one to determine a breach in the secondary tank without the use of moving parts. Using only gas and gas flow, one can monitor the pressures in the tank. The nitrogen flow into the interstitial space may also be used to keep the interstitial space dry by mixing with water vapor and removing such unwanted vapors as the gas flow passes through system. For instance, if any water is present in the interstitial space, the nitrogen gas may pick up water vapor and remove it through the ullage and into the atmosphere through a pressure vacuum valve. A transducer may be used within the ullage also to determine if the ullage is tight. Drops in pressure within the system may indicate leakage either in the interstitial space or the ullage.

One other object of the present invention is to dry the ullage, and potentially remove water vapor from the tank, fuel, contents, surfaces, etc. By injecting dry nitrogen gas into the tank, while preventing inflow of atmospheric gases to the ullage via the vent system (e.g. pressure vacuum valve), one may reduce water vapor in the system. By filling the ullage with inert gas, atmospheric gases are prevented from entering through vent. Furthermore, given the inert nature of the gas provided, hydrocarbon vapor will not exit the ullage out of the vent, and will remain packed tightly as a blanket, underneath the inert gas and over the hydrocarbon fuel liquids. It is presumed, that nitrogen gas is mostly immiscible with hydrocarbons.

The present invention is also useful to prevent loss of hydrocarbon vapor into the atmosphere. A gauge may be used to monitor over pressurization events, and a sensor measuring saturation of vapor may be used. It is preferred that the inflow of inert gas enters the ullage at one end far removed from the pressure vacuum valve to maximize the distance, or length, that the inert gas must pass over the ullage and contents before exiting the system. By maximizing the distance between the inflow of nitrogen gas into the ullage and exit from the ullage, we can maximize the amount of water vapor removed from the ullage. The farther the inert gas passes over the fuel within the tank, the more efficient the system can perform drying and cleansing of ullage. Preferably, the inert gas enters (either directly from source, or from opening to interstitial space) the primary tank ullage at one end far removed from the coupling of the vent tube with the primary tank ullage. With a flow, this will cause the inert gas to pass over the surface interface of liquid fuel in the tank, absorbing water vapor, etc., and taking the inert gas and any contaminants (preferably not RH) out the vent t atmosphere—shielding hydrocarbon vapor from exiting to atmosphere.

Nitrogen gas passes over as dry air over the liquid fuels within the tank. Water vapor transpires into the dry air, while hydrocarbon vapors are prevented from leaving due to the nature of the inert gas used. Furthermore, it is contemplated that water, either diluted or immersed in the hydrocarbon fuel, will exit the liquid and enter into the ullage and inert gases. As water vapor is removed, the vapor pressure of water in the ullage is reduced and thus may serve to draw more diluted, or floating or mixed, water from liquid fuel. Water vapor exiting the liquid fuel into the inert gas flow through the ullage may raise the humidity of the inert gas exiting the pressure vacuum valve. Monitoring water humidity of the gases provided at supply sensor 310, and comparing that to the humidity of the gases exiting at sensor 300, the amount of water exiting the fuel can be determined. Tests have shown that humidity of an inert gas provided, compared to that exiling the system, rose significantly when run over a diesel fuel in an underground storage tank, wherein the diesel was contaminated with water, thus eliminating water from the fuel and ultimately the system.

Testing has shown that by measuring humidity in the fuel tank, one can determine the amount of water exiling the system. In certain tests with extensive water contamination of a fuel source, an eighty percent (80%) relative humidity in the ullage was reduced to a five percent (5%) relative humidity by simply passing inert dry gas over the ullage for a period of twenty-four hours while maintaining a set pressure of supplied inert gas.

It is one object of the present invention to provide for drying of fuel in an underground storage tank. One may accomplish this object by monitoring the outflow of inert gas through the pressure vacuum valve, or any other exiting location. The monitoring may occur constantly in real time, or at set intervals during use of the tank. By continually or intermittently over pressurizing the tank with an inflow of inert gas, if water is present in the tank, water content (or vapor) may be detected on the outflow of the gases from the ullage. When a relative humidity sensor 300 detects a set threshold of water vapor in the outgoing gases, a drying cycle may commence. The drying cycle may be scheduled, triggered automatically at a set relative humidity, or otherwise provided in die system. Drying cycle may be automatically set at intervals, such as daily during known quiet times (low to zero fuel dispensation demand), or during certain day(s) of the week, monthly, etc. During the drying cycle, the inflow of nitrogen, or other inert, gases may be increased and the outflow of gases from the tank system may also increase in a relative amount. It is contemplated that by doubling the supply of inert gas, one may halve the amount of time needed to dry the tanks. Furthermore, testing of the relative humidity in the tank ullage may be provided on a set basis, rather that via continual supply of gas. One may purposely cause an over pressurization of the ullage via the use of injection of nitrogen gases into the system. The provision of inert gas may be provided at set automated times, for instance at a filling/dispensation event. Over pressurization may also occur at regular intervals, such as once per hour, etc. The over pressurization event is meant to cause the pressure vacuum valve to open, to allow measurement of relative humidity in the inert gas exiting the system at sensor 300.

The nitrogen blanketing system can cause drying, or may run drying cycles. The ullage in the tank is provided with a nitrogen blanket over the fuel fill line. Over pressurization of the tanks is caused by running nitrogen into the tank. This supply of inert gas may be provided on set intervals, such as every few hours. The gases exit through the pressure vacuum valve and the nitrogen gas is tested for relative humidity. If the relative humidity of exiting gas exceeds a certain threshold, the drying cycle may begin, and a steady supply of inert gas may be provided for an extended period (e.g. ten minutes, two hours, twenty-four hours, when a set dry level is achieved, or indefinitely, etc.). Furthermore, one can test the relative humidity in the interstitial space. Furthermore, one may test for the moisture level of the fuel knowing the relative humidity in the interstitial space via sensor 330. Preferably, relative humidity testing is occurring during a drying cycle.

Purge events may be also used to run high volume of nitrogen across tank ullage to remove all stale nitrogen gas in the tank and replace with fresh nitrogen gas. While prior art uses of nitrogen blanketing have been used via supply of nitrogen gas into the vent riser, one aspect of the present invention includes providing for nitrogen gas into the ullage at a separate point removed from the venting system. For instance, the nitrogen gas may be provided in an interstitial space riser. Other locations to add inert or nitrogen gas into the system may be along the top of the tank, or through other openings provided in the tank, preferably far from vent. Drying cycles may end automatically after a set amount of time, or when relative humidity reaches some lower threshold. Nitrogen may flow at a set speed, the level possible to be maintained either by production on site or at a low level that can be supplied by a source. Typical nitrogen gas tank sources can run at a very slow speed for fifty to two hundred to five hundred days. Given that inspections are typically made either monthly or at six-month intervals, the nitrogen tank source may be examined and/or replaced at those times.

Referring back to the figures, the pressure at point A and point B should be equivalent. If the pressure in A does not equal the pressure in B, that being the inflow and outflow of nitrogen gas, then an error in the system is detected. In other words, supplied volume should be close to equal to exiting volume(s). Failure to match supplied gas volume (or pressure) with exiting volume (or pressure) may indicate a leak. Such mismatch may also be due to water in the system. Sensors 310 and 300 may also be equipped to test volume, and/or pressures. Other possibilities causing such mismatches may be due to blockages that occur where nitrogen is provided and debris, or water, in the interstitial area raises pressure needed to cause venting out through B, or other issues with the tank system, are in error. It is preferred that nitrogen gas provided into the interstitial riser is provided not at the top of the rise, but at the bottom of the riser as shown in the bottom of FIG. 1 where a tube is run down through the interstitial riser down into the annular space, with an exit point within the annular space (here shown at a one hundred-twenty degree angle neck at bottom of tank. By adding a continual flow of nitrogen into the system, a set pressure may be achieved (such as five inches of water column pressure, preferably ranging one to thirty inches) whereby the pressure can be maintained. This same pressure may exit B into the ullage, whereby the pressure in the ullage may raise due to the inflow of gases, and at certain thresholds (such as ten inches of water column) may exit the pressure vacuum valve.

The system may provide for continual or intermittent over pressurizing of the ullage to cause outflows of exiting gas which can be monitored and tested for contaminants, such as water or hydrocarbon vapor. The system may be designed to deliver a dry inert gas continuously for a period of time; daily, weekly, monthly, based upon a storage interval quiet time. The system may be designed to monitor pressure at the source and outflow to determine if there is a leak in the primary or the interstice as described herein, and deliver dry inert gas continuously for a period of time; daily, weekly, monthly, based upon a storage interval quiet lime. The system may provide a continuous flow that is based upon a maximum (low volume) use on a daily basis, such determination can be made based on a running average of one or more months of use, and may vary based on time of year, etc. The system may also test for the RH level in die ullage, via a sensor at the top interior surface of the primary storage tank. Based on the RH level of the interstice and or the ullage moisture, the system may initiate a continuous flow of nitrogen to pass across either the ullage, and or the interstitial space between the primary and secondary containment tanks and the ullage when moisture is detected such as by a RH sensor reading the tank ullage vapor as it leaves the tank vent.

We claim:

1. A method for removing water and/or water vapor from a tank system, said method comprising the steps of:

a. supplying an inert gas into an interstitial space within the tank system;

b. drawing the inert gas out from the interstitial space directly over an ullage of the tank system;

c. releasing the inert gas from the tank system.

2. The method of claim 1 wherein said step of supplying provides for a continual pressure of inert gas over time.

3. The method of claim 2 further comprising the step of monitoring a flow of inert gas via a differential switch.

4. The method of claim 3 further comprising the step detecting presence of liquid in said interstitial space via a differential switch.

5. The method of claim 1 further comprising the step outflowing inert as from said interstitial space into the ullage of said tank system.

6. The method of claim 5 wherein said step of outflowing provides inert gas out of a riser at a riser opening.

7. The method of claim 5 wherein said step of supplying provides for forcing inert gas into the bottom of the interstitial space of the tank.

8. The method of claim 7 wherein said step of supplying provides for forcing inert gas up through a riser in fluid communication as between the interstitial space and the ullage.

9. The method of claim 7 wherein said step of supplying introduces inert gas into the interstitial space at the bottom of the riser via a tube run down through the riser into the interstitial space with an exit within the interstitial space.

10. The method of claim 1 further comprising the step of determining a breach b monitoring pressure in a as supply and gas flow through said interstitial space.

11. The method of claim 10 wherein said step of determining a breach comprises matching a supplied volume of inert gas with a volume of exiting gas.

12. The method of claim 1 further comprising the step of determining the amount of water exiting drawing water or water vapor from a fuel within said tank system by monitoring a humidity of gases drawn across the ullage and exiting past a sensor.

13. The method of claim 1 further comprising the step of initiating a drying cycle whereby the step of supplying increases an amount of inert gas inflow into the interstitial space.

14. The method of claim 13 wherein said step of initiating moves a humidity in either of said interstitial space or said ullage.

15. The method of claim 14 further comprising the step of testing a relative humidity in the interstitial space.

16. The method of claim 1 wherein said step of supplying is conducted through an interstitial riser.

17. The method of claim 1 further comprising the step of testing humidity levels and/or RH levels of exiting gases from system; and further comprising the step of initiating a continuous flow of inert gas when humidity and/or RH is detected in exiting gases.

18. A method for removing water and/or water vapor from a tank system, said method comprising the steps of:

supplying an inert gas into an interstitial space within the tank system;

releasing the inert gas from the tank system:

monitoring pressure in the interstitial space to identify a leak in a primary or interstice, and wherein said step of supplying comprises delivering a known amount of inert gas continuously for a period of time at a set interval, and monitoring the amount of exhaust gas.

19. A system for drying an ullage and/or interstitial space in a tank comprising:

a. an inert gas supply;

b. a conduit in fluid communication with the interstitial space of the tank;

c. a pump having an electrical supply line, said pump coupled with said conduit;

d. said conduit in fluid connection with said inert gas supply and an outlet of said conduit along said interstitial space;

e. a further outlet providing fluid communication between the interstitial space and a primary tank ullage;

f. a vent in communication with said ullage and an external atmosphere.

20. The system of claim 19 further comprising an interstitial riser with an exit at the bottom or along a bent corner of a supply tube within the interstitial space.

21. The system of claim 19 further comprising a humidity sensor along said vent.

22. The system of claim 19 further comprising a differential switch coupled with said conduit.

23. The system of claim 19 further comprising a RH and/or moisture sensor at a top interior surface of a primary storage tank of said tank.

24. The system of claim 10 wherein said further outlet comprises a riser opening within the tank, above a fuel level, within the ullage.

* * * * *